US005851235A

United States Patent [19]

Baillely et al.

[11] Patent Number: 5,851,235

[45] Date of Patent: Dec. 22, 1998

[54] DETERGENT COMPOSITION COMPRISING AN AMYLASE ENZYME AND A NONIONIC POLYSACCHARIDE ETHER

[75] Inventors: Gerard Marcel Baillely; Nour-Eddine Guedira; Robin Gibson Hall, all of Newcastle upon Tyne, Great Britain

[73] Assignee: The Procter & Gamble Company, Cincinnati, Ohio

[21] Appl. No.: 875,012

[22] PCT Filed: Feb. 6, 1996

[86] PCT No.: PCT/US96/01646

§ 371 Date: Jul. 16, 1997

§ 102(e) Date: Jul. 16, 1997

[87] PCT Pub. No.: WO96/25478

PCT Pub. Date: Aug. 22, 1996

[30] Foreign Application Priority Data

Feb. 15, 1995 [GB] United Kingdom ..... 9502914

[51] Int. Cl.[6] ..... C11D 3/386; C11D 3/22; C11D 3/395

[52] U.S. Cl. ..... 8/137; 510/299; 510/300; 510/302; 510/305; 510/306; 510/309; 510/320; 510/471; 510/473; 510/517

[58] Field of Search ..... 510/299, 300, 510/302, 305, 306, 309, 326, 473, 471, 517; 8/137

[56] References Cited

U.S. PATENT DOCUMENTS

| | | | |
|---|---|---|---|
| 4,000,093 | 12/1976 | Nicol et al. | 252/529 |
| 4,100,094 | 7/1978 | Burns et al. | 252/89 |
| 4,174,305 | 11/1979 | Burns et al. | 252/545 |
| 4,532,067 | 7/1985 | Padron | 252/174.17 |
| 5,009,800 | 4/1991 | Foster | 252/8.9 |
| 5,160,641 | 11/1992 | Foster | 252/8.6 |
| 5,691,295 | 11/1997 | Maurer et al. | 510/392 |
| 5,707,950 | 1/1998 | Kasturi et al. | 510/320 |

FOREIGN PATENT DOCUMENTS

| | | |
|---|---|---|
| 0213730 | 3/1987 | European Pat. Off. . |
| 0320296 | 6/1989 | European Pat. Off. . |
| 95 129224 | 11/1995 | WIPO . |

*Primary Examiner*—Kery Fries
*Attorney, Agent, or Firm*—R. S. Echler, Sr.; B. M. Bolam; K. W. Zerby

[57] ABSTRACT

The present invention relates to a detergent composition comprising an amylase enzyme in combination with a nonionic polysaccharide ether for improved stain removal performance.

13 Claims, No Drawings

DETERGENT COMPOSITION COMPRISING AN AMYLASE ENZYME AND A NONIONIC POLYSACCHARIDE ETHER

This application is a 371 application of PCT IUS96/00646 filed Feb. 6, 1996 and claims foreign priority from United Kingdom 9502914.6 filed Feb. 15, 1995.

FIELD OF THE INVENTION

The present invention relates to detergent composition comprising amylase enzymes and nonionic polysaccharide ethers providing improved stain removal.

BACKGROUND TO THE INVENTION

Amylase enzymes may be incorporated into detergent compositions to improve the removal of starch based stains such as chocolate, barbecue sauce and mustard is well known in the art, for example JP57028197, PCT/US93/06302 and PCT/US93/06877. In addition, EPO application no.: 94870041.4 (state of the art according to Article 54(3), EPC) discloses detergent compositions comprising percarbonate and from 0.1% to 0.6% of amylase at specific ratios to provide improved stain removal. EPO application no.: 94302880.3 (state of the art according to Article 54(3), EPC) discloses detergent compositions comprising from 0.05% to 1.5% of amylase, a polymeric dye transfer inhibitor and a dispersing agent. EPO application no.: 94302878.7 (state of the art according to Article 54(3), EPC) discloses detergent compositions comprising from 0.1% to 0.5% of specific fungal amylase enzymes.

Generally, the starch-based stain removal performance of amylase enzymes is directly related to their concentration in the detergent composition, so that an increase in the amount of amylase enzyme increases the stain removal performance. It has however been observed that under stressed conditions, such as the use of short washing machine cycles, or at low temperatures or in the presence of highly stained substrates, the optimum performance of the amylase enzyme is achieved at a certain level. Increasing the level of amylase enzyme beyond this amount does not result in increased stain removal performance benefits, particularly in the presence of bleach agents, especially percarbonate and at high pH levels.

It has now been found that the starch stain removal performance of an amylase enzyme can be unexpectedly improved under stressed conditions by its use in combination with a nonionic polysaccharide ether.

A further advantage of the present invention is that the starch-based stain removal benefits are observed after the completion of only one wash cycle. This is in contrast to the soil release and/or anti redeposition benefits associated with nonionic polysaccharide ethers which require multicycle application in order for these benefits to be observed.

The use of nonionic polysaccharide ethers as soil release agents have been described in the art. For example U.S. Pat. No. 4,136,038 discloses fabric conditioning compositions containing nonionic cellulose ethers having a molecular weight of 3000 to 10000 and ds of 1.8 to 2.7 as soil release agents. The compositions optionally comprise from 0.05% to 2% of detergency enzymes selected from protease, lipase, amylase and mixtures thereof. The combination of amylase and nonionic cellulose ether is not disclosed or exemplified.

EPO 495 257 discloses a compact detergent composition comprising high activity cellulase. Anti-redeposition agents including anionic and nonionic cellulose derivatives, in particular methyl cellulose, carboxymethylcellulose (CMC) and hydroxyethyl cellulose are disclosed but their dp and ds values are not disclosed. Other enzymes including amylase are disclosed, but the level of amylase is not disclosed or exemplified.

EPO 320 296 discloses fabric softening additives for detergent compositions comprising a water soluble nonionic ethyl hydroxyethyl cellulose having an HLB of 3.3 to 3.8, a dp of 50 to 1200 and a ds of 1.9 to 2.9. Enzymes including amylase are disclosed, but the amount is not disclosed or exemplified.

EPO 213 730 discloses detergent compositions with fabric softening properties comprising a nonionic substituted cellulose ether derivative, having a ds of from 1.9 to 2.9 and dp of 50 to 1200 and an HLB of 3.1 to 3.8 as an anti redeposition agent. Enzymes such as amylase are mentioned, but not the amount. The combination of cellulose ether and amylase is not exemplified.

However, none of the identified prior art document disclose the performance benefits associated with the combination of amylase enzyme with nonionic polysaccharide ethers of the present invention.

SUMMARY OF THE INVENTION

The present invention is a detergent composition comprising at least 1% of a surfactant characterised in that said detergent composition comprises the combination of a nonionic polysaccharide ether having a molecular weight of more than 10000 with an amylase enzyme selected from bacterial amylase, fungal amylase or mixtures thereof such that said detergent composition has an activity of at least 0.001KNU (Kilo Novo Units) per gram or at least 0.01FAU (Fungal Alpha Amylase Units) per gram.

All amounts, levels and percentages are given as a % weight of the detergent composition unless otherwise indicated.

DETAILED DESCRIPTION OF THE INVENTION

According to the present invention the detergent composition comprises as essential components an amylase enzyme in combination with a nonionic polysaccharide ether which provides improved soil removal performance.

Amylase

Suitable amylase enzymes include Endoamylases for example, α-amylases obtained from a special strain of *B. licheniforms,* described in more detail in GB-1296, 839 (Novo). Preferred commercially available amylases include for example Rapidase, sold by International Biosynthetics Inc. and Termamyl, sold by Novo Nordisk A/S. Other suitable amylases are fungal species such as Fungamyl commercially available from Novo Nordisk A/S.

Other suitable amylase enzymes for use herein include Exoamylases, for example β-amylases and χ-amylases derived of vegetable or microbial origin.

According to the present invention the bacterial amylase enzyme is present in the detergent composition such that said composition has an activity of at least 0.001 KNU, preferably from 0.001 KNU to 1000 KNU, more preferably from 0.01 KNU to 100 KNU, most preferably from 0.01KNU to 10KNU (Kilo Novo Units) per gram of detergent composition.

When a fungal amylase such as Fungamyl is used the level should be such as to provide an activity of the detergent composition in the range of at least 0.01 FAU preferably from 0.01 FAU to 10000 FAU, more preferably from 0.1 FAU to 1000 FAU, most preferably from 1 FAU to 100 FAU (Fungal Alpha Amylase Unit) per gram of detergent composition.

Nonionic Polysaccharide ethers

According to the present invention another essential component of the detergent composition is a nonionic polysaccharide ether having a molecular weight of more than 10000. Chemically, the polysaccharides are composed of pentoses or hexoses. Suitable polysaccharide ethers for use herein are selected from cellulose ethers, starch ethers, dextran ethers and mixtures thereof. Preferably said nonionic polysaccharide ether is a cellulose ether. Cellulose ethers are generally obtained from vegetable tissues and fibres, including cotton and wood pulp.

The hydroxy group of the anhydro glucose unit of cellulose can be reacted with various reagents thereby replacing the hydrogen of the hydroxyl group with other chemical groups. Various alkylating and hydroxyalkylating agents can be reacted with cellulose ethers to produce either alkyl-, hydroxyalkyl- or alkylhydroxyalkyl-cellulose ethers or mixtures thereof. The most preferred for use in the present invention are $C_1$–$C_4$ alkyl cellulose ether or a $C_1$–$C_4$ hydroxyalkyl cellulose ether or a $C_1$–$C_4$ alkylhydroxy alkyl cellulose ether or mixtures thereof. Preferably the polysaccharides of the present invention have a degree of substitution of from 0.5 to 2.8, preferably from 1 to 2.5, most preferably from 1.5 to 2 inclusive.

Suitable nonionic cellulose ethers include methylcellulose ether, hydroxypropyl methylcellulose ether, hydroxyethyl methylcellulose ether, hydroxypropyl cellulose ether, hydroxybutyl methylcellulose ether, ethylhydroxy ethylcellulose ether, ethylcellulose ether and hydroxy ethylcellulose ether. Most preferably said polysaccharide is a methylcellulose ether. Such agents are commercially available such as Methocel (Dow Chemicals).

According to the present invention said polysaccharide ether has a molecular weight from 10000 to 200000, most preferably from 30000 to 150000. The weight average molecular weight is obtained by standard analytical methods as described in Polymer handbooks. A preferred method is light scattering from polymer solutions as originally defined by Debye.

The compositions of the present invention comprise from 0.01% to 10%, preferably from 0.01% to 3%, most preferably from 0.1% to 2% of said nonionic polysaccharide ethers.

According to the present invention the detergent composition preferably comprises said bacterial amylase enzyme and said polysaccharide ether at a ratio of from 10000:1 to 1:10, preferably from 1000:1 to 1:1. The amylase being expressed in KNU and the nonionic polysaccharide ether being expressed in grammes. When a fungal amylase is used according to the present invention the ratio of said fungal amylase to said polysaccharide ether is a ratio of from 1000:1 to 1:1000, preferably from 1:100 to 1:100, wherein the fungal amylase is expressed in FAU and the polysaccharide ether is expressed in grams.

Detersive Surfactants

According to the present invention the detergent composition comprises at least 1% of a surfactant system. Surfactants useful herein include the conventional $C_{11}$–$C_{18}$ alkyl benzene sulphonates ("LAS") and primary, branched-chain and random $C_{10}$–$C_{20}$ alkyl sulphates ("AS"), the $C_{10}$–$C_{18}$ secondary (2,3) alkyl sulphates of the formula $CH_3(CH_2)_x(CHOSO_3^-M^+)CH_3$ and $CH_3(CH_2)_y(CHOSO_3^-M^+)CH_2CH_3$ where x and (y+1) are integers of at least about 7, preferably at least about 9, and M is a water-solubilizing cation, especially sodium, unsaturated sulphates such as oleyl sulphate, the $C_{10}$–$C_{18}$ alkyl alkoxy sulphates ("$AE_xS$"; especially EO 1–7 ethoxy sulphates), $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulphated polyglycosides, and $C_{12}$–$C_{18}$ alpha-sulphonated fatty acid esters.

If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulphobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants such as cationics are listed in standard texts.

According to the present invention the compositions comprise from 1% to 80%, preferably from 5% to 50%, most preferably from 10% to 40% of a surfactant. Preferred surfactants for use herein are linear alkyl benzene sulphonate, alkyl sulphates and alkyl alkoxylated nonionics or mixtures thereof.

Optional ingredients

According to the present invention the detergent compositions may comprise a number of optional conventional detergent adjuncts such as builders, chelants, polymers, antiredeposition agents and the like.

Builders

Detergent builders can optionally be included in the compositions herein to assist in controlling mineral hardness. Inorganic as well as organic builders can be used. Builders are typically used in fabric laundering compositions to assist in the removal of particulate soils.

The level of builder can vary widely depending upon the end use of the composition and its desired physical form. When present, the compositions will typically comprise at least 1% builder. Liquid formulations typically comprise from 5% to 50%, more typically about 5% to 30%, by weight, of detergent builder. Granular formulations typically comprise from 10% to 80%, more typically from 15% to 50% by weight, of the detergent builder. Lower or higher levels of builder, however, are not meant to be excluded.

Inorganic or P-containing detergent builders include, but are not limited to, the alkali metal, ammonium and alkanolammonium salts of polyphosphates (exemplified by the tripolyphosphates, pyrophosphates, orthophosphates and glassy polymeric meta-phosphates), phosphonates, phytic acid, silicates, carbonates (including bicarbonates and sesquicarbonates), sulphates, and aluminosilicates (see, for example, U.S. Pat. Nos. 3,159,581; 3,213,030; 3,422,021; 3,400,148 and 3,422,137).

However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2Si_2O_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}\cdot yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2Si_2O_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z[(SiO_2)_w(zAlO_2)_y]\cdot xH_2O$$

wherein w, z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}]\cdot xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

Chelating Agents

The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetracetates, N-hydroxyethylethylenediaminetriacetates, nitrilotriacetates, ethylenediamine tetraproprionates, triethylenetetra-aminehexacetates, diethylenetriaminepentaacetates, and ethanoldiglycines, alkali metal, ammonium, and substituted ammonium salts therein and mixtures therein.

Amino phosphonates are also suitable for use as chelating agents in the compositions of the invention when at least low levels of total phosphorus are permitted in detergent compositions, and include ethylenediaminetetrakis (methylenephosphonates) as DEQUEST. Preferred, these amino phosphonates to not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

If utilized, these chelating agents will generally comprise from 0.1% to 10% more preferably, from 0.1% to 3.0% by weight of such compositions.

Polymeric Soil Release Agent

Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower, (ii) $C_4$–$C_6$ alkylene or oxy $C_4$–$C_6$ alkylene segments, or mixtures therein, or (iii) poly (vinyl ester) segments, preferably polyvinyl acetate), having a degree of polymerization of at least 2.

Typically, the polyoxyethylene segments of (a)(i) will have a degree of polymerization of from about 200, although higher levels can be used, preferably from 3 to about 150, more preferably from 6 to about 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580, issued Jan. 26, 1988 to Gosselink.

Polymeric soil release agents useful in the present invention also include copolymeric blocks of ethylene terephthalate or propylene terephthalate with polyethylene oxide or polypropylene oxide terephthalate, and the like.

Soil release agents characterized by poly(vinyl ester) hydrophobe segments include graft copolymers of poly (vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al. Commercially available soil release agents of this kind include the Sokalan type of material, e.g., SOKALAN HP-22, available from BASF (Germany).

One type of preferred soil release agent is a copolymer having random blocks of ethylene terephthalate and polyethylene oxide (PEO) terephthalate. The molecular weight of this polymeric soil release agent is in the range of from about 25,000 to about 55,000. See U.S. Pat. No. 3,959,230 to Hays, issued May 25, 1976 and U.S. Pat. No. 3,893,929 to Basadur issued Jul. 8, 1975.

Another preferred polymeric soil release agent is a polyester with repeat units of ethylene terephthalate units contains 10–15% by weight of ethylene terephthalate units together with 90-80% by weight of polyoxyethylene terephthalate units, derived from a polyoxyethylene glycol of average molecular weight 300–5,000. Examples of this polymer include the commercially available material ZELCON 5126 (from Dupont) and MILEASE T (from ICI). See also U.S. Pat. No. 4,702,857, issued Oct. 27, 1987 to Gosselink.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451, issued Nov. 6, 1990 to J. J. Scheibel and E. P. Gosselink. Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink.

Preferred polymeric soil release agents also include the soil release agents of U.S. Pat. No. 4,877,896, issued Oct. 31, 1989 to Maldonado et al, which discloses anionic, especially sulfoarolyl, end-capped terephthalate esters.

If utilized, soil release agents will generally comprise from about 0.01% to about 10.0%, by weight, of the detergent compositions herein, typically from about 0.1% to about 5%, preferably from about 0.2% to about 3.0%.

Still another preferred soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises about one sulfoisophthaloyl unit, 5 terephthaloyl units, oxyethyleneoxy and oxy-1,2-propyleneoxy units in a ratio of from about 1.7 to about 1.8, and two end-cap units of sodium 2-(2-hydroxyethoxy)-ethanesulfonate. Said soil release agent also comprises from about 0.5% to about 20%, by weight of the oligomer, of a crystalline-reducing stabilizer, preferably selected from the group consisting of xylene sulfonate, cumene sulfonate, toluene sulfonate, and mixtures thereof.

Bleaching Compounds—Bleaching Agents and Bleach Activators

The detergent compositions herein may optionally contain bleaching agents or bleaching compositions containing a bleaching agent and one or more bleach activators. When present, bleaching agents will typically be at levels of from 1% to 40%, more typically from 5% to 30%, of the detergent composition, especially for fabric laundering. If present, the amount of bleach activators will typically be from 0.1% to 60%, more typically from 0.5% to 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches as well as other bleaching agents.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with silicate, borate or water-soluble surfactants. Preferred coatings are based on carbonate/sulphate mixtures. Percarbonate is available from various commercial sources such as FMC, Solvay and Tokai Denka.

Another category of bleaching agent that can be used without restriction encompasses percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. patent application 740,446, Burns et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6oxoperoxycaproic acid as described in U.S. Pat. No. 4,634,551, issued Jan. 6, 1987 to Burns et al.

Mixtures of bleaching agents can also be used. Peroxygen bleaching agents, the perborates, e.g., sodium perborate (e.g., mono- or tetra-hydrate), the percarbonates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. See also U.S. Pat. No. 4,634,551 for other typical bleaches and activators useful herein.

Highly preferred amido-derived bleach activators are those of the formulae:

$$R^1N(R^5)C(O)R^2C(O)L \text{ or } R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydroxyl anion. A preferred leaving group is phenol sulfonate.

Preferred examples of bleach activators of the above formulae include (6-octanamido-caproyl) oxybenzenesulfonate, (6-nonanamidocaproyl)-oxybenzenesulfonate, (6-decanamidocaproyl) oxybenzenesulfonate, and mixtures thereof as described in U.S. Pat. No. 4,634,551, incorporated herein by reference.

Another class of bleach activators comprises the benzoxazin-type activators disclosed by Hodge et al in U.S. Pat. No. 4,966,723, issued Oct. 30, 1990, incorporated herein by reference. A highly preferred activator of the benzoxazin-type is:

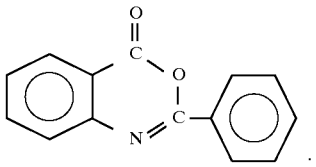

Still another class of preferred bleach activators includes the acyl lactam activators, especially acyl caprolactams and acyl valerolactams of the formulae:

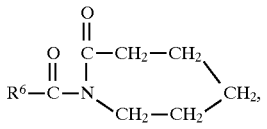

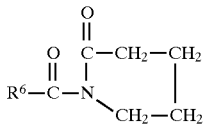

wherein $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985, incorporated herein by reference, which discloses acyl caprolactams, adsorbed into sodium perborate. Other preferred activators are cationic bleach activators.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from 0.025% to 1.25%, by weight, of such bleaches, especially sulfonate zinc phthalocyanine.

If desired, the bleaching compounds can be catalyzed by means of a manganese compound. Such compounds are well known in the art and include, for example, the manganese-based catalysts disclosed in U.S. Pat. No. 5,246,621, U.S. Pat. No. 5,244,594; U.S. Pat. No. 5,194,416; U.S. Pat. No. 5,114,606; and European Pat. App. Pub. Nos. 549,271A1, 549,272A1, 544,440A2, and 544,490A1; Preferred examples of these catalysts include $Mn^{IV}_2(u\text{-}O)_3(1,4,7\text{-trimethyl-}1,4,7\text{-triazacyclononane})_2(PF_6)_2$, $Mn^{III}_2(u\text{-}O)_1(u\text{-}OAc)_2(1,4,7\text{-trimethyl-}1,4,7\text{-triazacyclononane})_2\text{-}(ClO_4)_2$, $Mn^{IV}_4(u\text{-}O)_6(1,4,7\text{-triazacyclononane})_4(ClO_4)_4$, $Mn^{III}Mn^{IV}_4\text{-}(u\text{-}O)_1(u\text{-}OAc)_2\text{-}(1,4,7\text{-trimethyl-}1,4,7\text{-triazacyclononane})_2(ClO_4)_3$, $Mn^{IV}(1,4,7\text{-trimethyl-}1,4,7\text{-triazacyclononane})\text{-}(OCH_3)_3(PF_6)$, and mixtures thereof. Other metal-based bleach catalysts include those disclosed in U.S. Pat. No. 4,430,243 and U.S. Pat. No. 5,114,611. The use of manganese with various complex ligands to enhance bleaching is also reported in the following U.S. Pat. Nos. 4,728,455; 5,284,944; 5,246,612; 5,256,779; 5,280,117; 5,274,147; 5,153,161; 5,227,084;

Polymeric Dispersing Agents

Polymeric dispersing agents can advantageously be utilized at levels from 0.1% to 7%, by weight, in the compositions herein, especially in the presence of zeolite and/or layered silicate builders. Suitable polymeric dispersing agents include polymeric polycarboxylates and polyethylene glycols, although others known in the art can also be used. It is believed, though it is not intended to be limited by theory, that polymeric dispersing agents enhance overall detergent builder performance, when used in combination with other builders (including lower molecular weight polycarboxylates) by crystal growth inhibition, particulate soil release peptization, and anti-redeposition.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 90,000, most preferably from about 7,000 to 80,000. The ratio of acrylate to maleate segments in such copolymers will generally range from about 30:1 to about 1:1, more preferably from about 70:30 to 30:70. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol or acetate terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyamino acid dispersing agents such as polyaspartate and polyglutamate may also be used, especially in conjunction with zeolite builders. Dispersing agents such as polyaspartate preferably have a molecular weight (avg.) of about 10,000.

Clay Soil Removal/Anti-redeposition Agents

The compositions of the present invention can also optionally contain water-soluble ethoxylated amines having clay soil removal and antiredeposition properties. Granular detergent compositions which contain these compounds typically contain from about 0.01% to about 10.0% by weight of the water-soluble ethoxylates amines; liquid detergent compositions typically contain about 0.01% to about 5%.

The most preferred soil release and anti-redeposition agent is ethoxylated tetraethylenepentamine. Exemplary ethoxylated amines are further described in U.S. Pat. No. 4,597,898, VanderMeer, issued Jul. 1, 1986. Another group of preferred clay soil removal-antiredeposition agents are the cationic compounds disclosed in European Patent Application 111,965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti redeposition agents known in the art can also be utilized in the compositions herein. Another type of preferred antiredeposition agent includes the carboxy methyl cellulose (CMC) materials. These materials are well known in the art.

Dye Transfer Inhibiting Agents

The compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from 0.01% to 10% by weight of the composition, preferably from 0.01% to 5%, and more preferably from 0.05% to 2%.

More specifically, the polyamine N-oxide polymers preferred for use herein contain units having the following structural formula: R-$A_x$-P; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N═; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

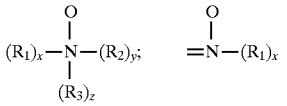

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa<10, preferably pKa<7, more preferred pKa<6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO".

The most preferred polyamine N-oxide useful in the detergent compositions herein is poly(4-vinylpyridine-N-oxide) which as an average molecular weight of about 50,000 and an amine to amine N-oxide ratio of about 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis,* Vol 113. "Modern Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present invention compositions also may employ a polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from about 500 to about 100,000, preferably from about 1,000 to about 10,000. Preferably, the ratio of PEG to PVP on a ppm basis delivered in wash solutions is from about 2:1 to about 50:1, and more preferably from about 3:1 to about 10:1.

The detergent compositions herein may also optionally contain from 0.005% to 5% by weight of certain types of hydrophilic optical brighteners which also provide a dye transfer inhibition action. If used, the compositions herein will preferably comprise from 0.01% to 1% by weight of such optical brighteners.

The hydrophilic optical brighteners useful in the present invention are those having the structural formula:

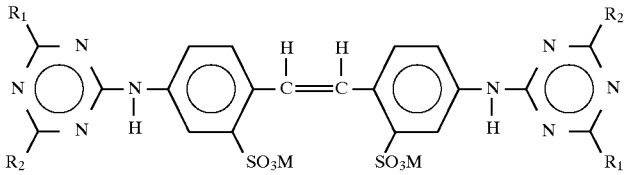

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

The specific optical brightener species selected for use in the present invention provide especially effective dye transfer inhibition performance benefits when used in combination with the selected polymeric dye transfer inhibiting agents hereinbefore described. The combination of such selected polymeric materials (e.g., PVNO and/or PVPVI) with such selected optical brighteners (e.g., Tinopal UNPA-GX, Tinopal 5BM-GX and/or Tinopal AMS-GX) provides significantly better dye transfer inhibition in aqueous wash solutions than does either of these two detergent composition components when used alone. Without being bound by theory, it is believed that such brighteners work this way because they have high affinity for fabrics in the wash solution and therefore deposit relatively quick on these fabrics. The extent to which brighteners deposit on fabrics in the wash solution can be defined by a parameter called the "exhaustion coefficient". The exhaustion coefficient is in general as the ratio of a) the brightener material deposited on fabric to b) the initial brightener concentration in the wash liquor. Brighteners with relatively high exhaustion coefficients are the most suitable for inhibiting dye transfer in the context of the present invention.

Of course, it will be appreciated that other, conventional optical brightener types of compounds can optionally be used in the present compositions to provide conventional fabric "brightness" benefits, rather than a true dye transfer inhibiting effect. Such usage is conventional and well-known to detergent formulations.

According to the present invention the detergent composition may comprise any other ingredients commonly employed in conventional detergent compositions such as soaps, suds suppressors, softeners, brighteners, additional enzymes and enzyme stabilisers.

Use of the combination of nonionic polysaccharide ethers and amylase enzymes

The compositions of the present invention may be used in laundry detergent compositions, fabric treatment compositions and fabric softening compositions in addition to hard surface cleaners. The compositions may be formulated as conventional granules, bars, pastes, powders or liquid forms. The detergent compositions are manufactured in conventional manner, for example in the case of powdered detergent compositions, spray drying or spray mixing processes may be utilised.

The polysaccharide ether and amylase enzyme combination of the present invention are present at aqueous concentrations of from 1 ppm to 500 ppm, preferably from 5 ppm to 300 ppm in the wash solution, preferably at a pH of from 7 to 11, preferably from 9 to 10.5.

The present invention also relates to a method of laundering fabrics which comprises contacting said fabric with an aqueous laundry liquor containing conventional detersive ingredients described herein in addition to the amylase enzyme and nonionic polysaccharide ether of the present invention. In a preferred method polyester and polyester-cotton blends fabrics are used.

EXAMPLES

Abbreviations used in Examples

In the detergent compositions, the abbreviated component identifications have the following meanings:

XYAS: Sodium $C_{1X}$–$C_{1Y}$ alkyl sulphate

25EY: A $C_{12-15}$ predominantly linear primary alcohol condensed with an average of Y moles of ethylene oxide XYEZ: A $C_{1x}$–$C_{1y}$ predominantly linear primary alcohol condensed with an average of Z moles of ethylene oxide XYEZS: $C_{1X}$–$C_{1Y}$ sodium alkyl sulphate condensed with an average of Z moles of ethylene oxide per mole TFAA: $C_{16}$–$C_{18}$ alkyl N-methyl glucamide.

Silicate: Amorphous Sodium Silicate ($SiO_2$:$Na_2O$ ratio =2.0)

NaSKS-6: Crystalline layered silicate of formula δ-$Na_2Si_2O_5$

Carbonate: Anhydrous sodium carbonate

MA/AA: Copolymer of 30:70 maleic/acrylic acid, average molecular weight about 70,000.

Zeolite A: Hydrated Sodium Aluminosilicate of formula $Na_{12}(AlO_2SiO_2)_{12}$. $27H_2O$ having a primary particle size in the range from 1 to 10 micrometers Citrate: Tri-sodium citrate dihydrate Percarbonate: Anhydrous sodium percarbonate bleach coated with a coating of sodium silicate ($Si_2O$:$Na_2O$ ratio=2:1) at a weight ratio of percarbonate to sodium silicate of 39:1

CMC: Sodium carboxymethyl cellulose

DETPMP: Diethylene triamine penta (Methylene phosphonic acid), marketed by Monsanto under the Tradename Dequest 2060

PVNO: Poly (4-vinylpyridine)-N-oxide copolymer of vinylimidazole and vinylpyrrolidone having an average molecular weight of 10,000.

Smectite Clay: Calcium montmorillonite ex. Colin Stewart Minchem Ltd.

Granular Suds Supperssor: 12% Silicone/silica, 18% stearyl alcohol,70% starch in granular form LAS: Sodium linear $C_{12}$ alkyl benzene sulphonate TAS: Sodium tallow alkyl sulphate SS: Secondary soap surfactant of formula 2-butyl octanoic acid Phosphate: Sodium tripolyphosphate TAED: Tetraacetyl ethylene diamine PVP: Polyvinyl pyrrolidone polymer HMWPEO: High molecular weight polyethylene oxide MC1: Methyl cellulose ether with molecular weight from 110000 to 130000, available from Shin Etsu Chemicals under the tradename Metolose MC2: Tylose MH50, available from Hoechst having a molecular weight>10000

MC3: Methocel F50, available from Dow Chemicals, having a molecular weight>10000

Amylase: Amylase enzyme sold under the tradename of Termamyl by Novo Nordisk A/S, having an activity of 60 KLU/g TAE 25: Tallow alcohol ethoxylate (25)

ACOBS: $C_9$/$C_{10}$ 6-nonanamidocaproyl oxybenzenesulphonate

Example 1

The following laundry detergent compositions A, B, C, D and E were prepared. Examples C, D, E and F represent embodiments of the present invention.

| | A | B | C | D | E | F |
|---|---|---|---|---|---|---|
| 45AS/25AS (3:1) | 9.1 | 9.1 | 9.1 | 9.1 | 9.1 | 9.1 |
| 35AE3S | 2.3 | 2.3 | 2.3 | 2.3 | 2.3 | 2.3 |
| 24E5 | 4.5 | 4.5 | 4.5 | 4.5 | 4.5 | 4.5 |
| TFAA | 2.0 | 2.0 | 2.0 | 2.0 | 2.0 | 2.0 |
| Zeolite A | 10.2 | 10.2 | 10.2 | 10.2 | 10.2 | 10.2 |
| Amylase | 0 | 0.75 | 0.75 | 0.75 | 0.75 | 0.75 |

-continued

| | A | B | C | D | E | F |
|---|---|---|---|---|---|---|
| MC1 | 0 | 0 | 0.5 | 1 | 0 | 0 |
| MC2 | 0 | 0 | 0 | 0 | 0.5 | 0.5 |
| Na SKS-6/citric acid (79:21) | 10.6 | 10.6 | 10.6 | 10.6 | 10.6 | 10.6 |
| Carbonate | 7.6 | 7.6 | 7.6 | 7.6 | 7.6 | 7.6 |
| TAED | 5 | 6.67 | 6.67 | 6.67 | 6.67 | 3 |
| Percarbonate | 22.5 | 22.5 | 22.5 | 22.5 | 22.5 | 22.5 |
| DETPMP | 0.5 | 0.5 | 0.5 | 0.5 | 0.5 | 0.5 |
| Protease | 0.55 | 0.55 | 0.55 | 0.55 | 0.55 | 0.55 |
| Polycarboxylate | 3.1 | 3.1 | 3.1 | 3.1 | 3.1 | 3.1 |
| CMC | 0.4 | 0.4 | 0.4 | 0.4 | 0.4 | 0.4 |
| PVNO | 0.03 | 0.03 | 0.03 | 0.03 | 0.03 | 0.03 |
| Granular suds suppressor | 1.5 | 1.5 | 1.5 | 1.5 | 1.5 | 1.5 |
| ACOBS | — | — | — | — | — | 3 |
| Minors/misc to 100% | | | | | | |

Soil removal testing, using a Miele washing machine, short cycle, 40° C., Newcastle city water, single dosage (75 g of detergent) was used. The fabric samples were stained with chocolate* or cocoa**. The chocolate was applied evenly spread over the fabric with a brush and left to dry over the bench overnight. The cocoa was finely divided and mixed into milk to form a homogeneous mixture. The mixture was spread evenly over the fabric with a brush and left to dry overnight.

Differences in greasy soil removal performance are recorded in panel score units (psu), positive having a better performance than the reference product, s indicating that the observed difference is significant at a 95% confidence level. The following grading scale (psu grading) was used:

0=equal

1=I think this one is better

2=I know this one is a little better

3=This one is a lot better

4=This one is a whole lot better

Grading was done under controlled light conditions by expert graders. The number of replicates used in this test was six.

| Panel score units | Detergent composition A | Detergent composition B | Detergent composition C |
|---|---|---|---|
| Average starch stains on cotton | 0 | +0.4 | +1.0s |
| Chocolate* | 0 | +0.3 | +1.1s |
| Cocoa** | 0 | +0.5 | +0.9 |
| Average stains on polycotton | 0 | +1.2 | +2.0s |
| Chocolate* | 0 | +0.8 | +1.8 |
| Cocoa** | 0 | +1.6s | +2.2s |

Chocolate*: Heinz baby chocolate pudding.
Cocoa**: Rowntrees cocoa in full fat pasturised milk.

Example 2

Granular fabric cleaning compositions in accord with the invention are prepared as follows:

| | I | II | III |
|---|---|---|---|
| Amylase | 0.5 | 0.5 | 0.5 |
| MC1 | 0.75 | — | — |
| MC2 | — | 0.75 | — |
| MC3 | — | — | 0.75 |

-continued

| | I | II | III |
|---|---|---|---|
| LAS | 22.0 | 22.0 | 22.0 |
| Phosphate | 23.0 | 23.0 | 23.0 |
| Carbonate | 23.0 | 23.0 | 23.0 |
| Silicate | 14.0 | 14.0 | 14.0 |
| Zeolite A | 8.2 | 8.2 | 8.2 |
| DETPMP | 0.4 | 0.4 | 0.4 |
| Sodium Sulfate | 5.5 | 5.5 | 5.5 |
| Water/minors | | Up to 100% | |

Example 3

Granular fabric cleaning compositions in accord with the invention are prepared as follows:

| | I | II | III |
|---|---|---|---|
| LAS | 12.0 | 12.0 | 12.0 |
| Zeolite A | 26.0 | 26.0 | 26.0 |
| SS | 4.0 | 4.0 | 4.0 |
| 24AS | 5.0 | 5.0 | 5.0 |
| Citrate | 5.0 | 5.0 | 5.0 |
| Sodium Sulfate | 17.0 | 17.0 | 17.0 |
| Perborate | 16.0 | 16.0 | 16.0 |
| TAED | 5.0 | 5.0 | 5.0 |
| MC2 | — | 0.5 | — |
| MC1 | 0.5 | — | — |
| MC3 | — | — | 0.5 |
| Amylase | 0.2 | 0.2 | 0.2 |
| Water/minors | | Up to 100% | |

Example 4

Granular fabric cleaning compositions in accord with the invention which are especially useful in the laundering of coloured fabrics are prepared as follows:

| | I | II | III | IV | V | VI |
|---|---|---|---|---|---|---|
| LAS | 11.4 | 10.7 | 11.4 | 10.7 | — | — |
| TAS | 1.8 | 2.4 | 1.8 | 2.4 | — | — |
| TFAA | — | — | — | — | 4.0 | 4.0 |
| 45AS | 3.0 | 3.1 | 3.0 | 3.1 | 10.0 | 10.0 |
| 45E7 | 4.0 | 4.0 | 4.0 | 4.0 | — | — |
| 25E3S | — | — | — | — | 3.0 | 3.0 |
| 68E11 | 1.8 | 1.8 | 1.8 | 1.8 | — | — |
| 25E5 | — | — | — | — | 8.0 | 8.0 |
| Citrate | 14.0 | 15.0 | 14.0 | 15.0 | 7.0 | 7.0 |
| Carbonate | — | — | — | — | 10 | 10 |
| Citric acid | 3.0 | 2.5 | 3.0 | 2.5 | 3.0 | 3.0 |
| Zeolite A | 32.5 | 32.1 | 32.5 | 32.1 | 25.0 | 25.0 |
| Na-SKS-6 | — | — | — | — | 9.0 | 9.0 |
| MA/AA | 5.0 | 5.0 | 5.0 | 5.0 | 5.0 | 5.0 |
| DETPMP | 1.0 | 0.2 | 1.0 | 0.2 | 0.8 | 0.8 |
| MC2 | — | — | 0.75 | 0.75 | 0.75 | — |
| MC1 | 0.5 | 0.5 | — | — | — | 0.75 |
| Amylase | 0.5 | 0.5 | 0.5 | 0.5 | 0.7 | 0.7 |
| Silicate | 2.0 | 2.5 | 2.0 | 2.5 | — | — |
| Sulphate | 3.5 | 5.2 | 3.5 | 5.2 | 3.0 | 3.0 |
| PVP | 0.3 | 0.5 | 0.3 | 0.5 | — | — |
| Poly(4-vinyl pyridine)-N oxide/copolymer of vinyl-imidazole & vinyl-pyrrolidone | — | — | — | — | 0.2 | 0.2 |
| Perborate | 0.5 | 1.0 | 0.5 | 1.0 | — | — |
| Phenol sulfonate | 0.1 | 0.2 | 0.1 | 0.2 | — | — |
| Water/Minors | | | Up to 100% | | | |

Example 5

Granular fabric cleaning compositions in accord with the invention are prepared as follows:

| | I | II | III |
|---|---|---|---|
| LAS | 6.5 | 8.0 | 8.0 |
| Sulfate | 15.0 | 18.0 | 18.0 |
| Zeolite A | 26.0 | 22.0 | 22.0 |
| Sodium nitrilotriacetate | 5.0 | 5.0 | 5.0 |
| PVP | 0.5 | 0.7 | 0.7 |
| TAED | 3.0 | 3.0 | 3.0 |
| Boric acid | 4.0 | — | — |
| Perborate | 0.5 | 1.0 | 1.0 |
| Phenol sulphonate | 0.1 | — | — |
| MC2 | 0.5 | — | — |
| MC1 | — | 0.75 | — |
| MC3 | — | — | 0.5 |
| Amylase | 0.7 | 0.7 | 0.7 |
| Silicate | 5.0 | 5.0 | 5.0 |
| Carbonate | 15.0 | 15.0 | 15.0 |
| Water/minors | | Up to 100% | |

Example 6

A granular fabric cleaning compositions in accord with the invention which provide "softening through the wash" capability are prepared as follows:

| | I | II | III | IV |
|---|---|---|---|---|
| 45AS | — | — | 10.0 | 10.0 |
| LAS | 7.6 | 7.6 | — | — |
| 68AS | 1.3 | 1.3 | — | — |
| 45E7 | 4.0 | 4.0 | — | — |
| 25E3 | — | — | 5.0 | 5.0 |
| Coco-alkyl-dimethyl hydroxy ethyl ammonium chloride | 1.4 | 1.4 | 1.0 | 1.0 |
| Citrate | 5.0 | 5.0 | 3.0 | 3.0 |
| Na-SKS-6 | — | — | 11.0 | 11.0 |
| Zeolite A | 15.0 | 15.0 | 15.0 | 15.0 |
| MA/AA | 4.0 | 4.0 | 4.0 | 4.0 |
| DETPMP | 0.4 | 0.4 | 0.4 | 0.4 |
| Perborate | 15.0 | 15.0 | — | — |
| Percarbonate | — | — | 15.0 | 15.0 |
| TAED | 5.0 | 5.0 | 5.0 | 5.0 |
| Smectite clay | 10.0 | 10.0 | 10.0 | 10.0 |
| HMWPEO | — | — | 0.1 | 0.1 |
| MC2 | — | 0.5 | — | 0.5 |
| MC1 | 0.5 | — | 0.5 | — |
| Amylase | 0.5 | 0.5 | 1 | 1 |
| Silicate | 3.0 | 3.0 | 5.0 | 5.0 |
| Carbonate | 10.0 | 10.0 | 10.0 | 10.0 |
| Granular suds suppressor | 1.0 | 1.0 | 4.0 | 4.0 |
| CMC | 0.2 | 0.2 | 0.1 | 0.1 |
| Water/minors | Up to 100% | | | |

Example 7

A liquid fabric cleaning composition in accordance with the invention was prepared as follows:

| | I | II |
|---|---|---|
| 25AS | 16.5 | — |
| 25AE3S | 3.00 | 18.00 |
| TFAA | 5.50 | 4.50 |
| 24E5 | 5.63 | 2.00 |
| Fatty Acid/oleic acid | 7.50 | 2.00 |
| Citric Acid | 1.00 | 3.00 |
| Ethanol | 1.37 | 3.49 |
| Propanediol | 11.75 | 7.50 |
| MEA | 8.00 | 1.00 |
| NaCS | — | 2.50 |
| Na/Ca Formate | — | 0.09 |

-continued

| | I | II |
|---|---|---|
| NaOH | 1.00 | 3.11 |
| Lipase | 0.13 | 0.12 |
| Protease | 0.48 | 0.88 |
| Cellulase | 0.03 | 0.05 |
| Amylase | 0.13 | 0.120 |
| Boric (Borax)/Ca formate | 3.25 | 3.50 |
| Brightener | 0.15 | 0.05 |
| MA/AA | 0.22 | 1.18 |
| DETPMP | 0.94 | — |
| MC1 | 0.5 | 0.5 |
| Water & misc. | up to 100% | |

We claim:

1. A detergent composition comprising:

a) 1% to 80% by weight, of a detersive surfactant;

b) from 0.01% to 10% by weight, of a nonionic polysaccharide ether which is a methyl cellulose ether having a molecular weight of 110,000 to 130,000; and c) an amylase enzyme in an amount wherein the activity of said amylase enzyme is at least 0.001 Kilo Novo Units or at least 0.01 Fungal Alpha Amylase Units per gram of composition;

d) 5% to 30% of a percarbonate bleach.

2. A composition according to claim 1 comprising wherein said surfactant is selected from the group consisting of anionic, nonionic, ampholytic surfactants, and mixtures thereof.

3. A composition according to claim 2 wherein said surfactant is linear alkylbenzene sulfonate, alkyl sulfate, alkyl alkoxylate, and mixtures thereof.

4. A composition according to claim 1 wherein said methyl cellulose ether has a degree of substitution from 1 to 2.5.

5. A composition according to claim 4 wherein said methyl cellulose ether has a degree of substitution from 1.5 to 2.

6. A composition according to claim 1 wherein said amylase enzyme has an activity of from 0.001 Kilo Novo Units to 1,000 Kilo Novo Units.

7. A composition according to claim 1 wherein said enzyme is α-amylase.

8. A composition according to claim 1 wherein the ratio of said amylase enzyme to said nonionic polysaccharide ether is from 10,000:1 to 1:10.

9. A composition according to claim 1 further comprising carriers and other adjunct ingredients, said adjunct ingredients selected from the group consisting of builders, chelating agents, soil release agents, bleaches, bleach activators, bleach catalysts, dispersing agents, anti-redeposition agents, dye transfer inhibitors, and mixtures thereof.

10. A detergent composition comprising:

a) 1% to 80% by weight, of a detersive surfactant;

b) from 0.01% to 10% by weight, of a methyl cellulose having a molecular weight from 110,000 to 130,000; and c) an amount of α-amylase enzyme wherein the activity of said enzyme is at least 0.001 Kilo Novo Units or at least 0.01 Fungal Alpha Amylase Units per gram of composition;

d) 5% to 30% of a percarbonate bleach.

11. A composition according to claim 10 further comprising at least 1% by weight of a builder.

12. A composition according to claim 10 wherein the ratio of said amylase enzyme to said nonionic polysaccharide ether is from 10,000:1 to 1:10.

13. A method for treating fabrics consisting of the step of contacting fabric with an aqueous solution containing from 1 ppm to 500 ppm of a laundry detergent composition comprising:

a) 1% to 80% by weight, of a detersive surfactant;

b) from 0.01% to 10% by weight, of a nonionic polysaccharide ether a methyl cellulose ether having a molecular weight of at least 10,000; and c) an amylase enzyme in an amount wherein the activity of said amylase enzyme is at least 0.001 Kilo Novo Units or at least 0.01 Fungal Alpha Amylase Units per gram of composition;

d) 5% to 30% of a percarbonate bleach.

* * * * *